US009814364B1

(12) United States Patent
Caruso

(10) Patent No.: US 9,814,364 B1
(45) Date of Patent: Nov. 14, 2017

(54) CLEANING APPARATUS WITH LARGER DEBRIS PICK UP

(71) Applicant: Steven Jerome Caruso, Antioch, IL (US)

(72) Inventor: Steven Jerome Caruso, Antioch, IL (US)

(73) Assignee: SHARKNINJA OPERATING LLC, Newton, MA (US)

( * ) Notice: Subject to any disclaimer, the term of this patent is extended or adjusted under 35 U.S.C. 154(b) by 0 days.

(21) Appl. No.: 14/536,663

(22) Filed: Nov. 9, 2014

Related U.S. Application Data

(60) Provisional application No. 61/902,285, filed on Nov. 10, 2013, provisional application No. 61/982,845, filed on Apr. 22, 2014.

(51) Int. Cl.
*A47L 11/24* (2006.01)
*A47L 11/40* (2006.01)
(Continued)

(52) U.S. Cl.
CPC ..... *A47L 11/24* (2013.01); *A47L 11/4013* (2013.01); *A47L 11/4025* (2013.01); *A47L 11/4041* (2013.01); *A47L 11/4055* (2013.01); *A47L 11/4069* (2013.01); *A47L 11/4075* (2013.01); *A47L 11/33* (2013.01); *A47L 13/12* (2013.01)

(58) Field of Classification Search
CPC ..... A47L 11/08; A47L 11/085; A47L 11/18; A47L 11/185; A47L 11/19; A47L 11/22; A47L 11/24; A47L 11/26; A47L 11/282; A47L 11/32; A47L 11/33; A47L 11/4013; A47L 11/4025; A47L 11/4041; A47L 11/4052; A47L 11/4055; A47L 11/4069; A47L 11/4075; A47L 11/4086
USPC ... 15/39.5, 23, 25–27, 4, 114, 115, 41.1, 42, 15/46, 48.1, 50.3, 51, 52, 52.1, 79.1, 15/79.2, 98
See application file for complete search history.

(56) References Cited

U.S. PATENT DOCUMENTS 488,950 A * 12/1892 Raymond ..... A47L 11/33 15/41.1
781,543 A * 1/1905 McClay ..... E01H 1/045 15/41.1
(Continued)

FOREIGN PATENT DOCUMENTS

DE 2347831 * 4/1975
GB 635413 * 4/1950
(Continued)

OTHER PUBLICATIONS

Partial machine translation of WO 2006/005722, Jan. 19, 2006.*

*Primary Examiner* — Mark Spisich
(74) *Attorney, Agent, or Firm* — Ntellect Law, P.C.

(57) ABSTRACT

New and novel structure(s) for cleaning surfaces have been disclosed. The device may include: a wiping surface, which may be disposable; a brush roll/larger debris gathering mechanism; a local debris storage and/or staging area, and a larger remote debris storage structure. Additionally, there are mechanisms and structures disclosed for powering the brush roll, activating the brush roll from an out of use position to an in use position, and moving the waste from one area to another. The invention at hand uniquely and inventively improves upon the known devices in this field.

7 Claims, 9 Drawing Sheets

(51) Int. Cl.
*A47L 11/33* (2006.01)
*A47L 13/12* (2006.01)

(56) References Cited

U.S. PATENT DOCUMENTS

| | | | | | |
|---|---|---|---|---|---|
| 861,528 | A | * | 7/1907 | Lord | A47L 11/4069 15/52 |
| 1,300,323 | A | * | 4/1919 | Zdancewicz | A47L 11/33 15/41.1 |
| 2,037,902 | A | * | 4/1936 | Hertzberg | A47L 11/33 15/39.5 |
| 2,557,216 | A | * | 6/1951 | Calabrese | A47L 11/33 15/179 |
| 2,982,981 | A | * | 5/1961 | Waara | A47L 11/32 15/114 |
| 3,947,912 | A | * | 4/1976 | Michaels | E01H 1/045 15/79.1 |
| 2003/0204923 | A1 | * | 11/2003 | Nakamura | A46B 13/02 15/4 |
| 2004/0168281 | A1 | * | 9/2004 | Sako | A47L 5/28 15/364 |
| 2007/0214586 | A1 | * | 9/2007 | Mattucci | A46B 5/0054 15/4 |

FOREIGN PATENT DOCUMENTS

| | | | |
|---|---|---|---|
| GB | 774399 | * | 5/1957 |
| GB | 829550 | * | 3/1960 |
| JP | 7-265239 | * | 10/1995 |
| WO | 2006-005722 | * | 1/2006 |

* cited by examiner

CLEANING APPARATUS WITH LARGER DEBRIS PICK UP

RELATED APPLICATIONS

This application claims the benefit of U.S. provisional application Ser. No. 61/902,285 filed on Nov. 10, 2013. It also incorporates by reference U.S. provisional application Ser. No. 61/902,285 filed on Nov. 10, 2013 in its entirety. This application also claims the benefit of U.S. provisional application Ser. No. 61/982,845 filed on Apr. 22, 2014. It also incorporates by reference U.S. provisional application Ser. No. 61/982,845 filed on Apr. 22, 2014 in its entirety. Each application in this paragraph is incorporated here by reference in its entirety to provide continuity of disclosure. The entire disclosures of all applications are hereby incorporated herein by reference.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

The present invention relates generally to devices for cleaning surfaces.

In the art of devices for cleaning surfaces, there exists a multitude of appliances that each serve a particular function. There are vacuums (that may or may not include a brush roll), there are sweepers (brush roll only devices), and there are mops and wiper devices. Each have their distinct advantages and disadvantages. The invention at hand seeks to inventively improve upon these devices by combining the positive attributes of each without being encumbered by the negative attributes of each in new and novel ways.

BRIEF SUMMARY OF THE INVENTION

The present invention is a new and novel structure(s) for cleaning surfaces. Embodiments may include; a wiping surface, which may be disposable; a brush roll larger debris gathering mechanism; a local debris storage and/or staging area, and a larger remote debris storage structure. Additionally, there are mechanisms and structures disclosed for powering the brush roll, activating the brush roll, and moving the waste from one area to another.

REFERENCE CHARACTERS USED

Figure 1:
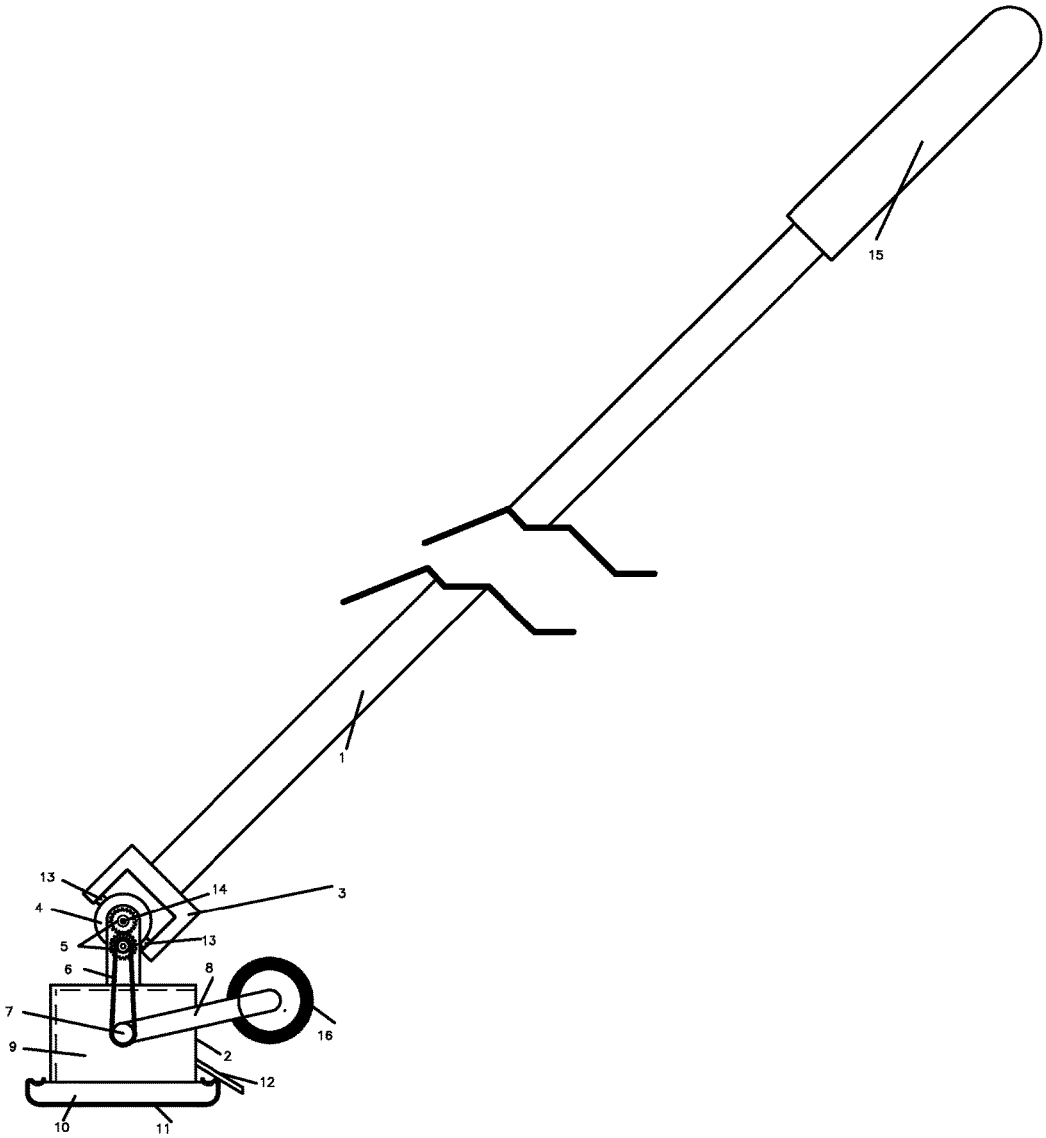
FIG. 1 is a side view of the invention in a first position.

The following reference characters are used in the drawings of refer to the parts of the present invention. Like reference characters indicate like or corresponding parts in the respective views.

1—handle upright
2—Receptacle opening
3—Side to side Pivot block (part of fore-aft, right-left swivel gimble)
4—Front to back pivot element (part of fore-aft, right-left swivel gimble)
5—Gears for transmitting motion/and/or—reversing motion
6—Belt drive for transmitting motion/and/or reversing motion
7—Pivot of arm 8
8—Brush roll arm
9—Debris receptacle
10—Sweeper Pad holder
11—Cloth
12—Debris ramp
13—Pivot of 3
14—Pivot of 4 and pivot of one of 5
15—Handle grip area
16—brush roll, may be bristled or a flap like or bladed rubber/elastomeric etc. structure or disk like
17—Conveyor structure—may be a conveyor belt or an auger etc.
18—Receptical may be a bin, a bag—permanent or disposable.
19—Cam
20—Motor and/or brush roll drive
21—Belt drive for transmitting motion
22—user switch
23—positional switch
24—pivotal link
25—Batteries
26—Stabilising leg

DETAILED DESCRIPTION OF THE INVENTION

While the invention will be described in connection with several preferred embodiments, it will be understood that the invention is not limited to these embodiments. On the contrary, the invention includes all alternatives, modifications, combinations, and equivalents as may be included within the spirit and scope of the appended claims.

The present invention relates generally to devices for cleaning surfaces.

In the art of devices for cleaning surfaces, there exists a multitude of appliances that each serve a particular function. There are vacuums (that may or may not include a brush roll), there are sweepers (brush roll only devices), and there are mops and wiper devices. Each has their distinct advantages and disadvantages. The invention at hand seeks to inventively improve upon these devices by combining the positive attributes of each without being encumbered by the negative attributes of each in new and novel ways.

The present invention is a new and novel structure(s) for cleaning surfaces. Embodiments may include; a wiping surface, which may be disposable; a brush roll larger debris gathering mechanism; a local debris storage and/or staging area, and a larger remote debris storage structure. Additionally, there are mechanisms and structures disclosed for powering the brush roll, activating the brush roll, and moving the waste from one area to another.

One of the problems with a traditional vacuums is that it can only pick up small debris, yet really small debris on relatively smooth surfaces such as a bare floor etc. are better left to a wet-mop/dry mop/disposable wipe type appliance. Then larger debris such as nuts, bolts, pieces of cereal are best left to a sweeper, or a broom and a dustpan, as the suction of an atmospheric vacuum based system is limited. Additionally, a vacuum typically is large and cumbersome to maneuver and get into tight areas, under cupboards, next to toilets, around furniture etc. and is not conducive to quick cleanups.

While a sweeper can get some of the larger debris, it fails at getting the fine dirt that a vacuum or a mop/wiper can get, it tends to throw it around. So it lacks those attributes a vacuum and a mop/wiper has.

One of the paramount problems with existing wet/dry mops is their inability to pick up debris of a larger given size. Once it is larger than sand/hair etc. it just gets pushed around. The problem with putting a traditional brush roll out front, is that the positive attributes of leading with a wipe (into corners etc.) would be obviated, and a brush roll cannot be trailing, in the rear, as the wipe would "snowplow" everything before the brush roll had a chance to do its job. Atmospheric vacuums can pick up items that a mop can't, but at a given weight to size ratio of debris, they fail too.

So while there is functional crossover between these three, not one does all. And so this invention addresses these shortcomings with a new and novel configuration.

It should be noted, that these inventive structures and disclosure may be integrated with an atmospheric vacuum cleaner, another sweeper type cleaner, wet mops, dry mops, steam-mops, or other steam generating/cleaning devices, cleaning devices that use a granular cleaning agent that needs to be subsequently picked up etc.

A brush roll is used in conjunction with a mop/wiper, whether it be of the wet or dry, disposable or permanent type. The brush roll, may or may not be only in selective contact with the surface to be cleaned. The brush roll may be powered by friction wheel(s) and gearing from movement on the surface to be cleaned, such as manual sweepers are and is known in the art. Alternatively the brush roll may be powered by an electric motor, a wind up motor, an air turbine etc. In one mode of use the mop pad leads and then when debris is encountered, the brush roll is lowered and it then can do its work. The brush roll may be mounted to the front, and lowered by a mechanism, a trigger, a motor etc. initiated by the user or another input. Some of the details of these variations are not shown directly in the figures, but is very close, or nearly identical, to the configuration of FIG. 2. Which will be discussed in detail below. Additionally, the term "brush roll" is meant to encompass both generally cylindrical structures with an axis of rotation generally along or through its longest dimension, where the axis of rotation is generally perpendicular to the earths ground plane, as well as spinning brushes or disks or pads that have an axis of rotation that is generally parallel to the earths ground plane.

Figure 9:
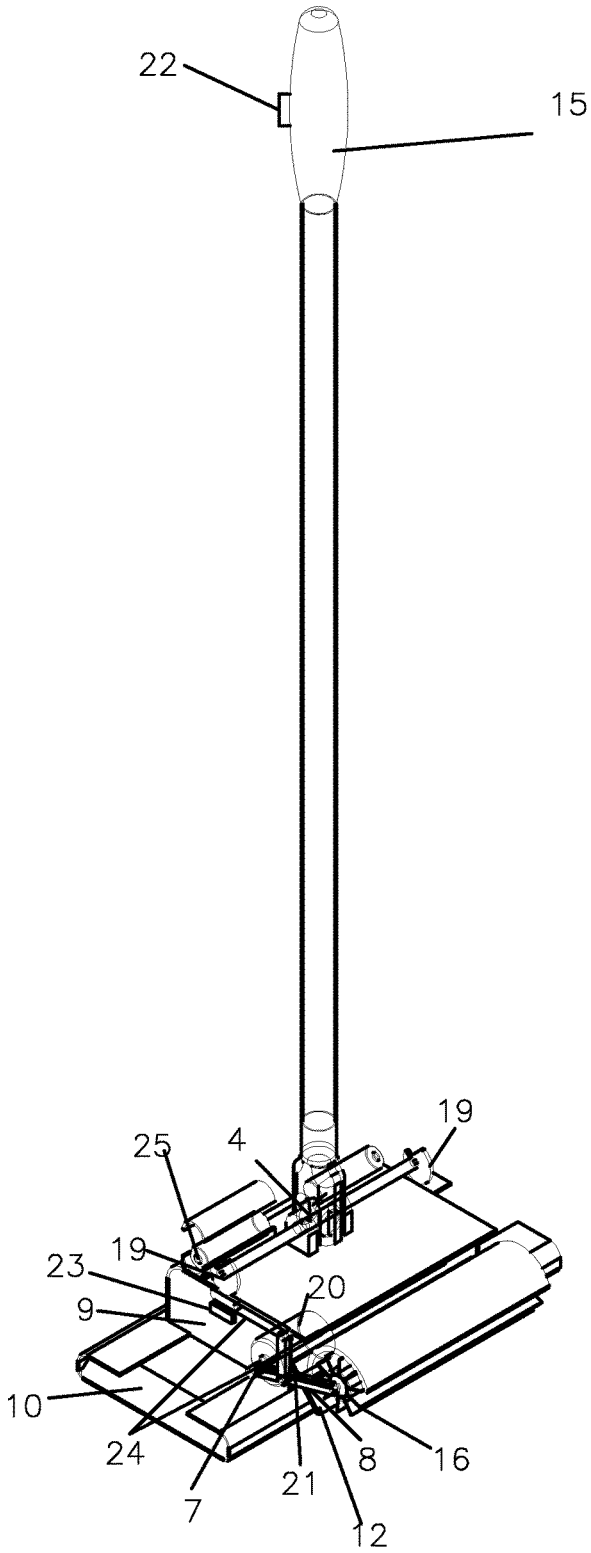
FIG. 9 is an enlarged trimetric view similar to the trimetric view in FIG. 8. Many of the inventive elements can be seen in this view as well.

A preferred embodiment though is to have the unit have "two" generally speaking, discreet positions. One is where the pad leads, and the brush roll follows—at a disengaged position from the surface to be cleaned. This keeps the brush roll clear from obstacles such as furniture and walls, and allows the pad to get as close as possible, and also allows the user an unobstructed view of the cleaning area of the leading edge. The second position is where the entire unit has been swiveled/pivoted around once larger debris is encountered. Now the brush roll is leading. A very important aspect is that this configuration allows the unit to be used like a broom, pulling debris out from corners, getting close to chair legs, making a pile of debris, and then swiveling the unit around, for the second position to sweep up. This is very different than the mode of using a vacuum or traditional sweeper, although this unit allows that mode of cleaning as well. It can accomplish both. The brush roll may be lowered by a trigger or other input from the user, or by another input such as a positional or debris sensor. And it may be powered by its frictional interface, or another wheel to the surface to be cleaned, or by an electrical input by the user inputting a switch or by electrification due to a positional switch, sensor or other input. In a preferred embodiment, the swiveling and reorientation relative to the handle accomplishes the lowering of the brush roll arm 8 to the surface to be cleaned, and may further activate the switching electrification of an electric driven (in this embodiment) brush roll 16. An important aspect of all the embodiments is that at least a part of, and in some cases all of the mechanism(s) for powering the brush roll move with the brush roll. In some embodiments, the entire mechanism, whether it be a motor with or without gearing, connecting belts etc., or a wind-up or frictional motor moves with the boom arm 8, or functionally equivalent similar structure, even the batteries 25 as best illustrated in FIG. 9 may be carried in the case of an electric motor. In other embodiments, only selected parts of the brush roll motive drive move with the brush roll. In a preferred embodiment the brush roll is carried on an arm. That arm swings about a pivot. And the rotational center axis point of that pivot is generally shared by the center rotational axis point of the driving motor. The motor is generally affixed and stationary with regard to the foot of the device. And a brush roll driving belt connects the motor to the brush roll generally parallel to the pivot arm. In this way the pivot arm, and brush roll and driving belt are all swinging a generally similar arc that maintains the belt in a correct driving geometry at all times. This is covered in greater detail with regard to FIG. 6.

Figure 2:
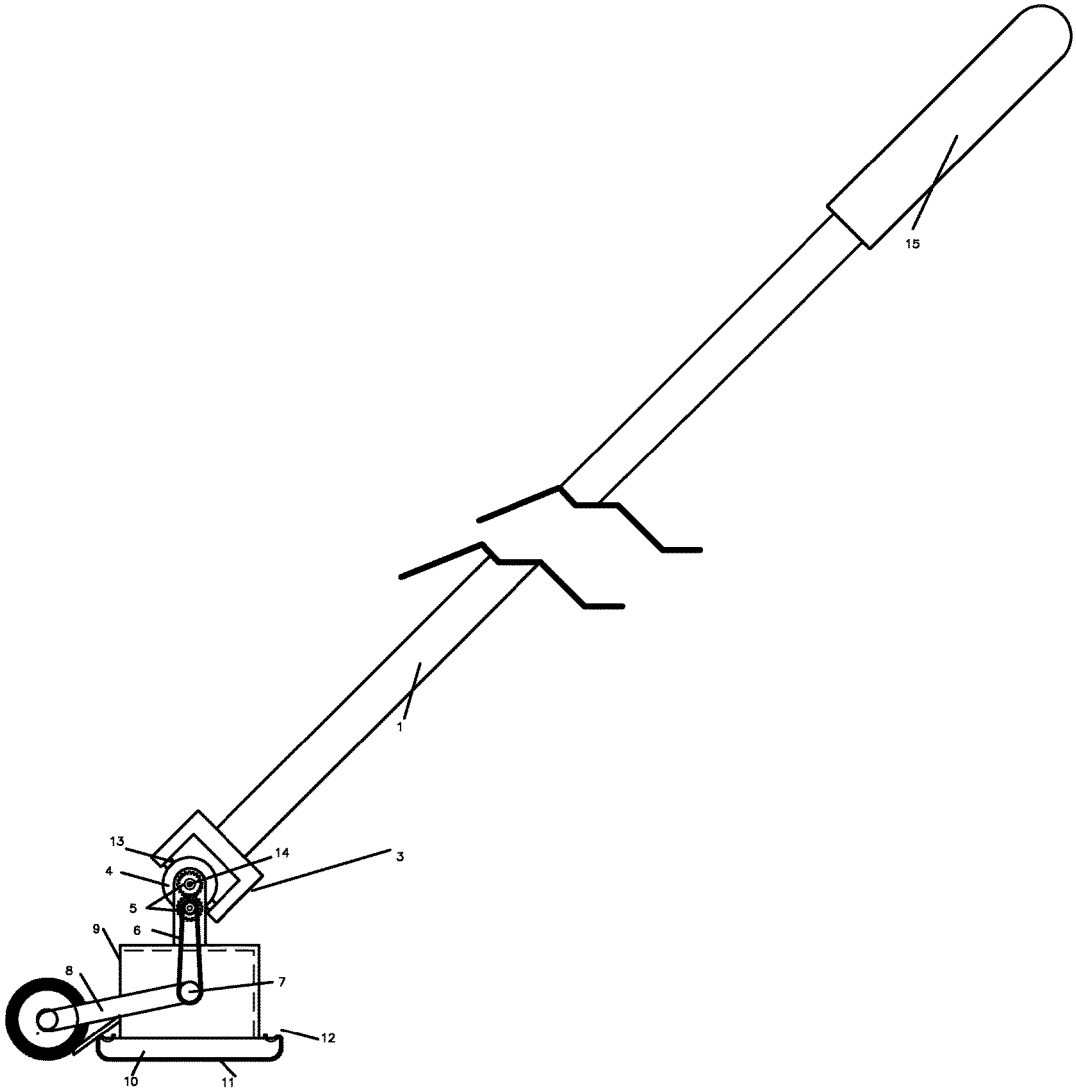
FIG. 2 is a side view of the invention in a second position.
Figure 3:
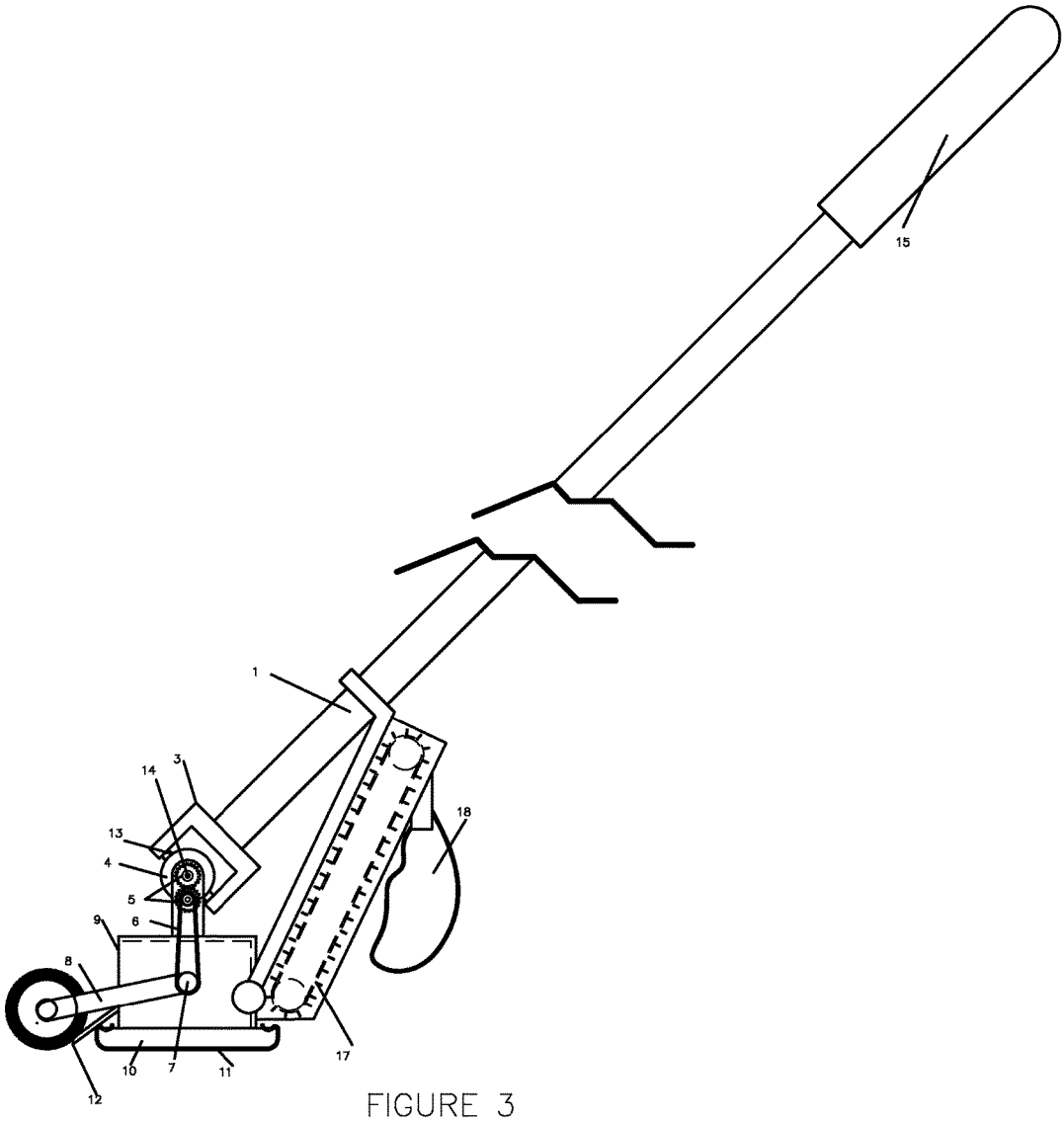
FIG. 3 is a side view of the invention in a second position and showing another embodiment that includes novel methods of further moving debris from the floor via a conveyor belt like system or an auger. Such a further system may further contain the debris into a larger area, or conveniently into a bag, perhaps generically disposable such as used grocery bags, illustrated by 16.

So now, referring to FIGS. 1 to 3, side views of the invention can be seen. A device for cleaning floors can be seen. Devices such as these are often used as a wet or dry mop. Some of these devices can accommodate disposable wipers, be they wet or dry. Several of the embodiments of this invention are able to incorporate such wipes. FIGS. 1 and 2 show the invention in two different positions, and FIG.

3 shows an alternative embodiment(s) to the invention. FIG. 1 shows that the invention may include a handle upright 1, and that the it may further include a universal type joint made up of a side to side pivot block 3, its associated pivot points 13 which pivot generally fore and aft on front to back pivot element 4. In this way the pad can swivel generally 180 degrees while remaining on the ground by the user pivoting their hand and the handle a generally equivalent amount. Another equivalent structure(s) may be substituted and still be within the spirit and scope of the invention. Now it can be seen that the invention includes a drive associated with the pivot 14 of 4 front to back pivot. The drive in this case includes a gear(s) 5 which then drives belt 6 which is operatively connected to 7, pivot of brush roll arm 8. Any number of gears or belts or other linkages etc. may be substituted to achieve a similar function. The result is a structure that is capable of changing modes from having a brush roll in an out of the way/out of use position, to having the same brush roll having an in use position. In this embodiment the user uses the implement as in FIG. 1 as a traditional mop, be it wet or dry, be it with semi-permanent cloths 11, or disposable of the Swiffer™ style from the Proctor and Gamble company or equivalent. The user is able to use these cloths 11 or wiping surfaces unimpeded by a brush roll or similar structure, and thus is able to get close to items, areas, under areas, and also be able to see the point of cleaning of the pads etc. With an unobstructed view. Incidentally, a brush roll may be bristled or not, as it may be a bladed structure, a non-roll like structure such as spinning discs etc., it (brush roll) is just a catchall all terminology for those structures which perform a general sweeping agitating function. Referring back to the figures, then when the user wants to use the brush roll or similar structure, the user swivels the entire structure about the handle so that what was the back of the structure, where the brush roll 16 and opening 2 is now in the front as can best be seen in FIG. 2. In doing so, the angle of the handle to the rest of the structure has changed in a generally "mirrored" way from that of FIG. 1 to that of FIG. 2. And Front to back pivot element 4, thus drives pivot 14 which drives gears 5, driving belt 6 and pivot 7 bringing brush roll arm 8 down and thus brush roll 16 into active contact with the surface to be cleaned and into a cleaning position into the front of the unit where it will encounter larger debris before the wiping pads 11 and may deposit it into debris receptacle 9 via receptacle opening 2 via debris ramp 12. In conjunction with this movement, the brush roll or similar structure is brought into rotary power. One anticipated mode is by way of an electric motor—not shown. The action of bringing the sweeper brush roll or other structure into contact with the surface to be cleaned can simultaneously activate a switch, which may be located at one of several points in the associated moving linkage, or be directional sensing so that when the unit is flipped/rotated, it becomes activated. In an alternative embodiment, the switch is located on the handle 22 generally near the users hand, or lower on the base or "foot" of the unit 23. In the embodiments with a switch 22 on or near the handle/handgrip area 15, when combined with unit that already has a switch 22 on the handle, the handle may have two switches, one on either side. One example is when this invention is incorporated into a device such as Proctor and Gambles WetJet mop. Provisions are anticipated for disabling the switch that is not to be activated based on the position of the handle and thus mode the device is in. These provisions are electrically or mechanically disabling the switch which is not to be used when it is in a given position, and creating geometry associated with the switch which makes it less likely to activate it in an out of use position. These same disabling methods are anticipated when the switch(s) 23 are to be located on or in greater proximity to the foot of the device. In another alternative embodiment, the brush roll or alternative structure is powered frictionally from drive wheels or other structure in contact with the floor or surface to be cleaned. Another important feature that is applicable to versions of all embodiments is that the mechanism may be allowed to "over-travel" as far as the brush rolls engagement with the floor, and be spring loaded. In this way, a wide variety of in use handle positions may be supported, and so the position of the brush roll is not absolutely "clocked" into the rotation of the handle, thus once it is in contact with the floor, there is variance in the angle of the handle allowable because a spring biasing or other biasing force keeps the brush roll in active contact. Additionally, appropriate structures such as wheels, friction blocks etc. may be used to make sure the brush/flap roll is in appropriate contact, but not too frictionally in contact with the surface to be cleaned. An alternate to having it spring loaded is to use gravity when the unit has been lowered. In this way, as with spring loading, the unit may even ride, or "crawl" over debris that normally would be too large for its brush/flap clearance and its diameter. Another important note is that while the movement of 8 and the brush roll was activated by pivots 14 of 4, it also could be keyed into pivots 13 of 3 of the universal-multi-axis-gimble-pivot structure depicted. So it could be keyed into pivots 13 instead of, or in addition to being keyed into pivot(s) 14 so a variety of actuation movements/motions is anticipated.

It should be noted that features of all the embodiments disclosed in this disclosure may be combined and recombined in various ways, and combined with a unit that is not "flippable" as well. In those embodiments, the brush roll may be on the front of the unit, and either always on contact with the surface to be cleaned or lower able and raisable on the front as has already been described in detail with regard to flippable embodiments.

Now referring to FIG. 3, another embodiment can be appreciated. This view has many similarities to FIG. 2 in that the brush roll etc. is rotated to the front etc. Of note is 17, powered Conveyor structure which as depicted—may be a conveyor belt or alternatively, not depicted, may an auger etc. Also shown is 18, Receptical. This receptacle may be a bin, or a bag—permanent or disposable. In this way the debris may be moved from the floor or surface to be cleaned or from 9 debris receptacle so that the unit may have increased cleaning capacity. Additionally, it may be easier for the user to empty the debris, and additionally further the user may use disposable bags perhaps even of the grocery variety to dispose of the debris without ever having to touch it or have a dust plume from dumping the waste. The augur or belt may be powered by an electric motor or by friction wheels/movement of the device relative to the surface to be cleaned as in other embodiments.

Figure 4:
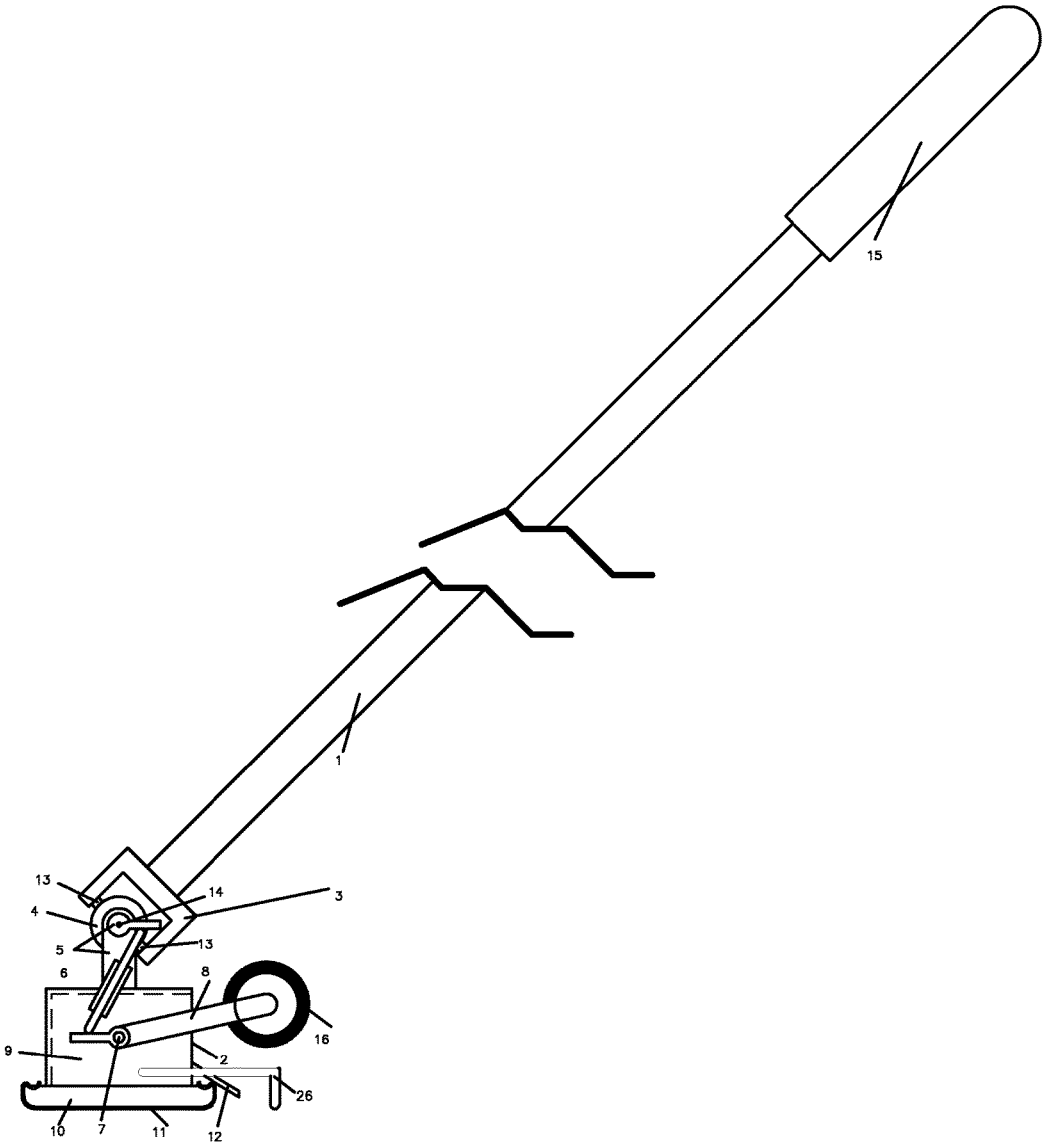
FIG. 4 is a view similar to FIG. 1 in that it is a side view of the invention in a first position. The predominant difference(s), is that an alternate linkage arrangement incorporating a sliding piston-link is depicted.

Referring to FIG. 4 is a view similar to FIG. 1 in that it is a side view of the invention in a first position. The predominant difference(s), is that an alternate linkage arrangement incorporating a sliding piston-link is depicted.

Figure 5:
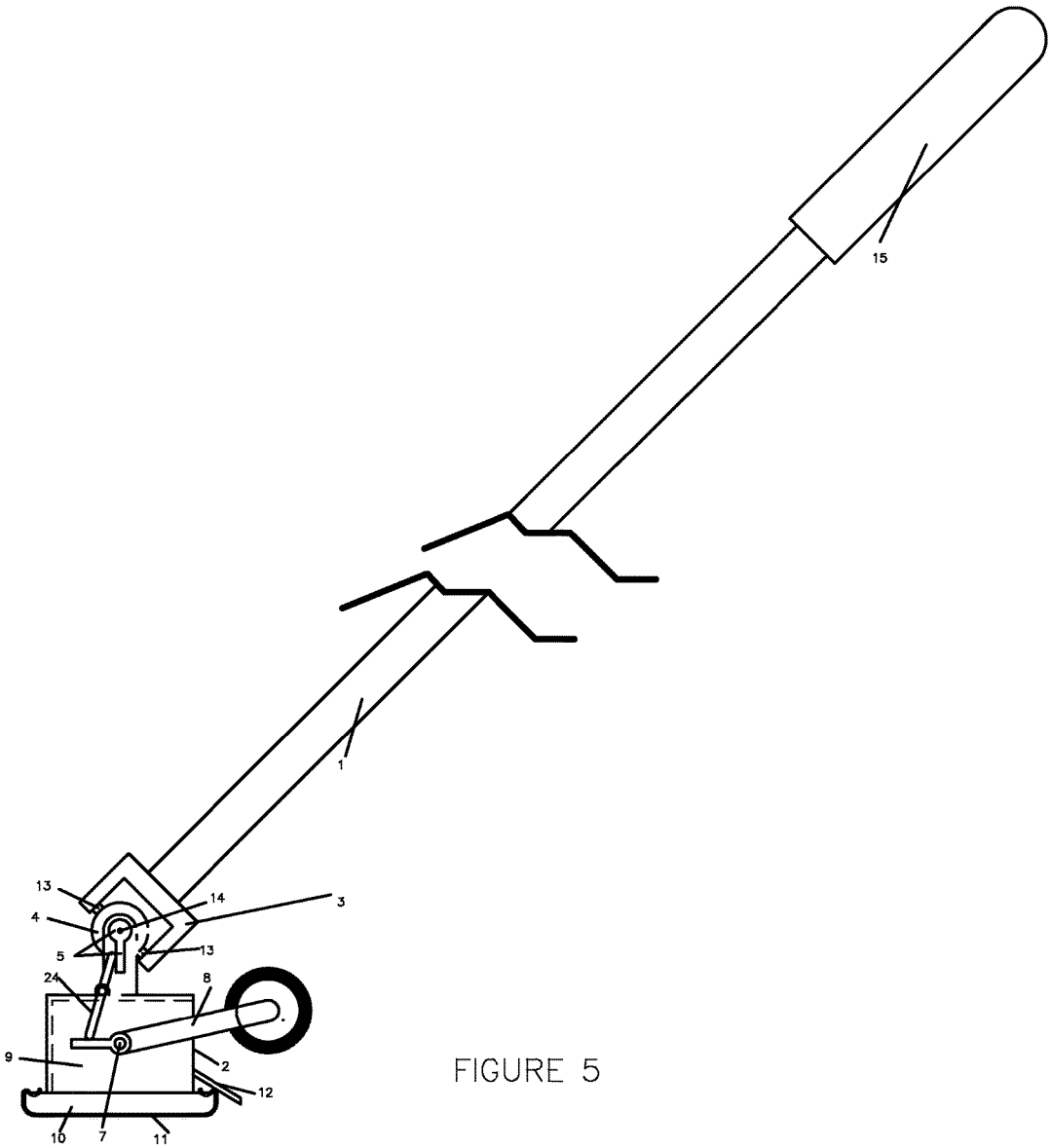
FIG. 5 is a view similar to FIG. 1 in that it is a side view of the invention in a first position. The predominant difference(s), is that an alternate linkage arrangement is depicted.

Referring to FIG. 5 is a view similar to FIG. 1 in that it is a side view of the invention in a first position. The predominant difference(s), is that an alternate linkage arrangement is depicted. Like that of FIG. 1 the drive in FIG. 5 includes a gear 5 which is operatively connected to 7, pivot of brush roll arm 8. In this embodiment of FIG. 5 the gears and the belts are linked via a pivotal link 24 to achieve a similar function as that of FIG. 1.

Figure 6:
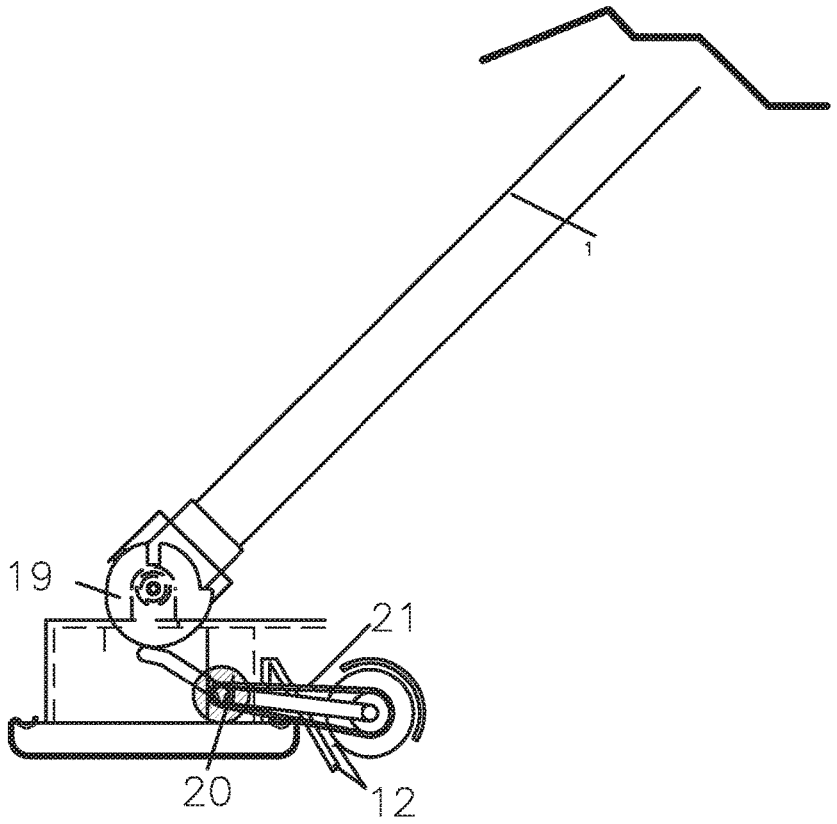
FIG. 6 is a side view of the invention in a first position. One difference(s), is that an alternate linkage including a cam 19, arrangement is depicted. Further alternate linkages include partially geared interfaces for producing intermittent, and/or phased movement as the levers, belts and cams of other alternative embodiments/versions thus illustrated. Also depicted in this view is either a movable debris ramp.

Referring to FIG. 6 is a side view of the invention in a first position. The predominant difference(s), is that an alternate linkage including a cam 19 arrangement is depicted. Further alternate linkages include partially geared interfaces for producing intermittent, and/or phased movement as the levers, belts and cams of other alternative embodiments/versions thus illustrated. Of note is a drive that can be selectively used in many embodiments and is a preferred embodiment. There is a motor, 20 and a drive belt 21 for driving the brush roll. Of note also is that the center of the motor and that of the boom 8, are shared, or the same. This is important as it makes it so that the drive belt 21, works regardless of rotational position of boom 8. Similarly a gear train could be carried by the boom 8, to totally obviate, or partially obviate the belt 21. Here again though, it is an inventive feature to have the motor and the boom share a pivot, so that a gear from the motor would properly mesh with one on the boom, regardless of rotational position of boom 8.

Figure 7:
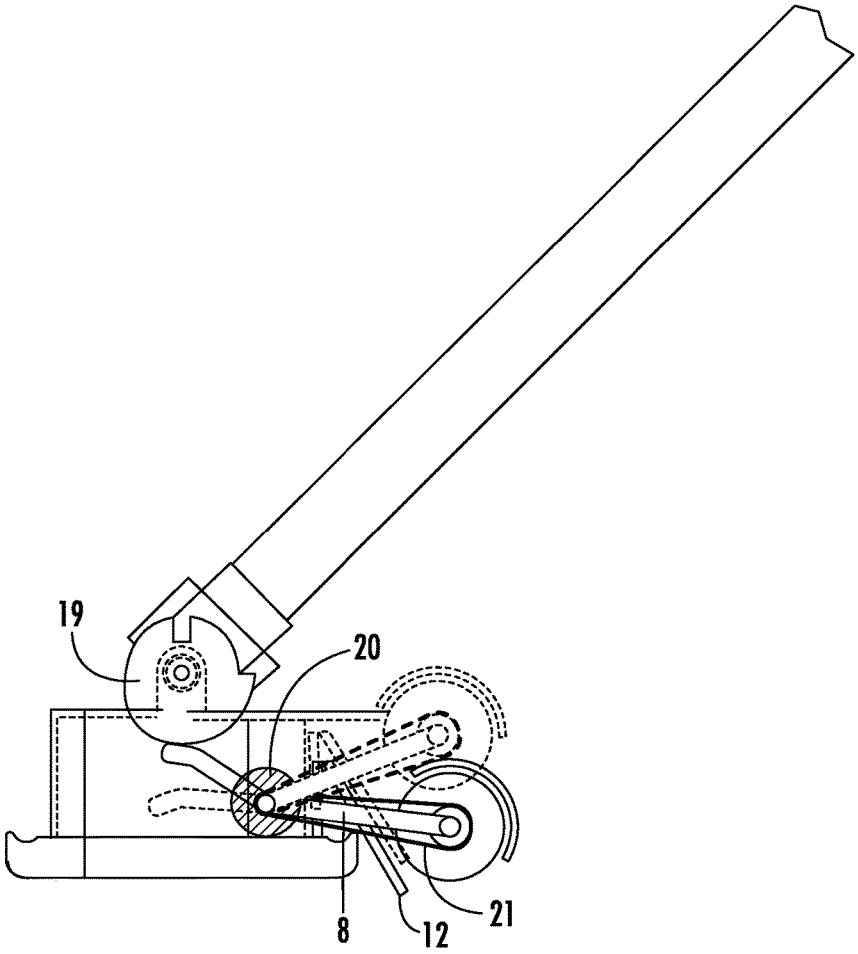
FIG. 7 is a view substantially similar to that of FIG. 6. This figure further shows the brush roll and the ramp and a debris bin closure door which is constructed as part of/or connected to the ramp in its two positions, in use-solid lined, and out of use, dotted lined.

FIG. 7 is a view substantially similar to that of FIG. 6. This figure further shows the brush roll and the ramp and a debris bin closure door which is constructed as part of/or connected to the ramp in its two positions, in use-solid lined, and out of use, dotted lined.

Figure 8:
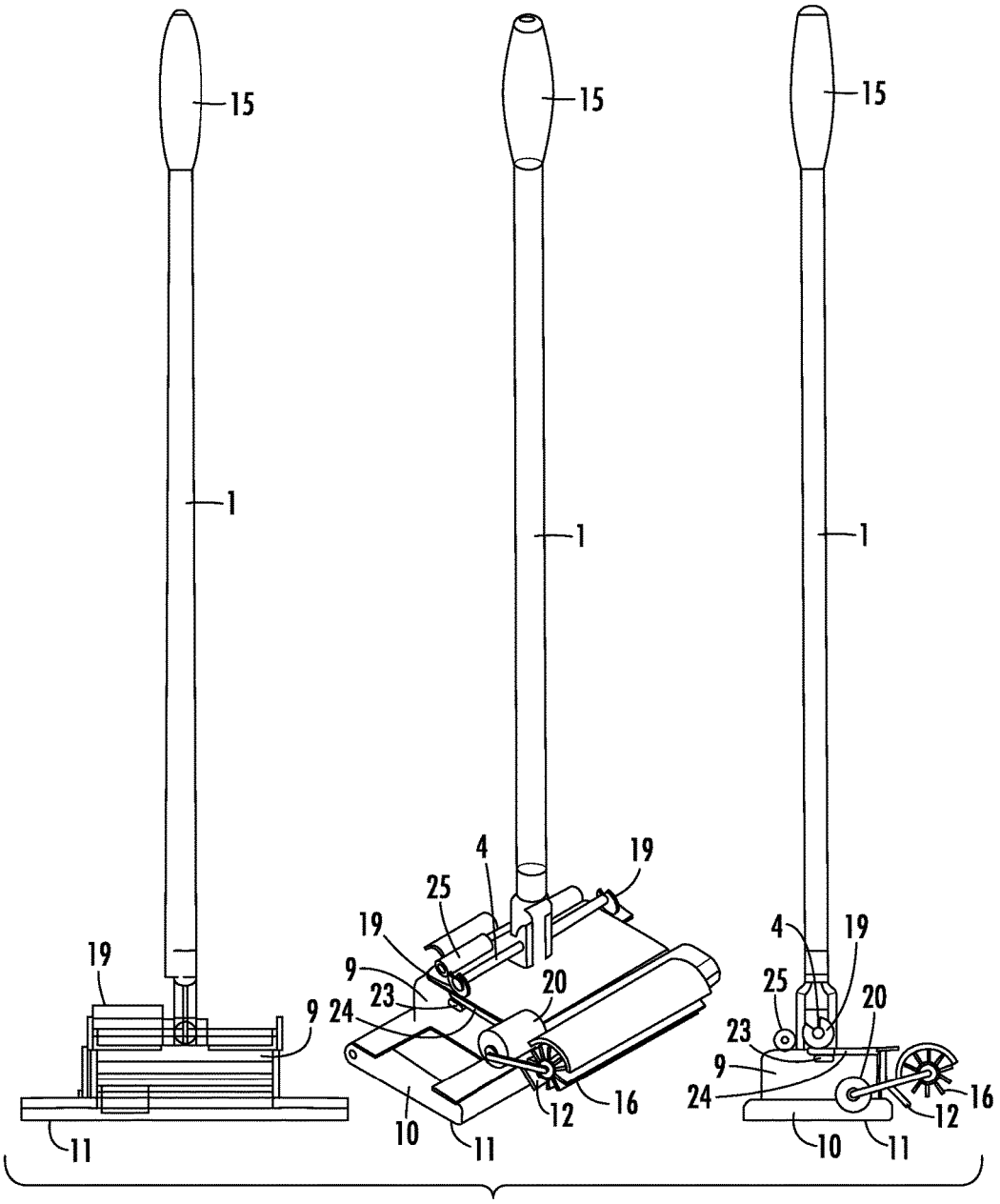
FIG. 8 is a collection of three views of embodiments of the invention(s). From left to right there is a rear view, a rear trimetric, and a side view.

FIG. 8 is a collection of three views of embodiments of the invention(s). From left to right there is a rear view, a rear trimetric, and a side view.

FIG. 9 is an enlarged trimetric view similar to the trimetric view in FIG. 8. Many of the inventive elements can be seen in this view as well. Of note in this view, and is selectively applicable to all embodiments disclosed is dual sided design. In other words, the mechanism(s) may be located in a relatively outboard fashion. So there would be left and right cams (if this were the embodiment of choice) and left and right pivot links etc. This has been found to be a very unique and important design feature in loosening manufacturing tolerances, the ability to make lighter and smaller components, and solve numerous alignment and "clocking/timing" issues as opposed to driving the raising and lowering of the brush roll boom by a single interface. Additionally, a single interface becomes spatially challenging as the design needs to be clear of the brush roll in the center, and also allow the handle to go nearly flat to the main box/debris housing, and be able to swivel unencumbered on its fore-aft, right-left swivel gimble. The inventive design benefits by utilizing the vertical space to the side of the debris bin. It further benefits by creating a symmetrical design whereby the mechanism can operate on either side of the debris box for reasons already outlined. The motive drive may be on a single side, or centered—usually preferable when it is electric, or on both sides as well-usually preferable when it is frictional.

The following are anticipated structures and modes that are also may be selectively combined with any of the embodiments.

Issues of stability have been encountered when the device is cleaning floors with varying or changing frictional interface to the padded/cleaning wipe surface. Some of this has to do with the altered weight distribution of the brush roll being cantilevered, and some has to do with the altered center of gravity of having the fore-aft, right-left swivel gimble positioned higher, now on top of the debris box instead of directly on the pad area. One inventive solution to this problem is to have stabilizing legs that extend out and touch the floor before the unit can tip. These may be in constant contact with the floor, or spaced enough not to touch until needed. Referring again to FIG. 4, stabilizing leg(s) 26 can be seen. The area that could/would touch the surface to be cleaned can be characterized as a stabilizing foot. This leg/foot can be immediately outboard, or inboard of brush roll pivoting arm 8, and debris box 9. Additionally, it could be centered, used on both sides etc. Of note is that it is configured to not interfere with the debris pad, allowing it to properly function, and allowing the user to be able to easily change cloths 11 etc. from the pad holder 10.

Also of note is that that the rotation of the brush roll could power a clutch etc. to lower the brush roll boom.

As previously noted various linkages are anticipated including pivot bars, cams, gears, partially geared members/the inclusion of a partially geared "drop-off" linkages, belts, Geneva mechanisms, etc. and various combinations of each.

Also disclosed are embodiments with the possible inclusion of (optionally folded/foldable), disposable debris boxes for wet or messy debris. This could be a box in mother box design, or a disposable box in a reusable removable box in a mother box and optionally removable/mounting area. In other words, there may be an area on/in the device for holding debris as already described. This area, may also, optionally, hold another holding area (box) that is removable and may or may not be disposable. In this way, it may be removed, and dumped without having to invert the entire mechanism. If it the inner box is disposable, it may be emptied, or simply thrown away. In this way the user can either use the removable-reusable/non disposable debris tray or box, and/or optionally line it with a disposable liner.

Also disclosed are embodiments with the possible inclusion cover or lid for the general entry-way of the aforementioned debris area. This may be spring loaded, and/or activated by a clutch via the various rotational/moving components.

This door may be attached or part of the boom 8, and/or the debris ramp, and/or brush/flap roll fender. This can be generally seen in FIG. 6, where debris ramp has a lowered position when boom and brushroll/flaproll are lowered which is indicated by both in solid lines. And then when boom and brushroll/flaproll are raised which is indicated by both in dashed lines, the ramp or an associated section of it, 9 as shown) or a separate non associated section (not shown) acts as a cover for the debris collection area.

So as depicted, the cover or lid opens with the lowering of the boom and/or becomes the debris ramp and thus also gets out of the way of the pad for use and pad changing. This ramp may only go down close to the floor, and may further include a flexible member like a squeegee, hinged or not, thus allowing the pad to still do the fine cleaning.

This inclusion of the ramp moving up and down—can be especially important for wet floor cleaning so that it does not drag etc.

Also disclosed are embodiments with the inclusion of spring loading of the entire unit relative to the handle, so that when it is stored, the debris box is facing upward. This would put the unit into a position so that the debris would not fall out.

I claim:

1. A surface cleaning device comprising:

a block-shaped receptacle having an opening defining a debris inlet adjacent a ramp for directing debris from the surface into an interior of the receptacle; said receptacle further having a bottom surface;

a pad holder disposed on the bottom surface of the receptacle, said pad holder configured to retain a cleaning cloth on a bottom surface thereof for cleaning the surface;

a rotary brush roll disposed adjacent a side of the receptacle such that the brush roll sweeps debris into the receptacle through the debris inlet, the brush roll coupled to the receptacle by a movable arm, the brush roll being operably coupled to a motor for driving the brush roll in rotation;

an elongate handle movably coupled to an upper surface of the receptacle by an articulated connection; and wherein the handle and the movable arm of the brush roll are connected to each other in such a manner that movement of the handle results in movement of the brush roll arm such that the brush roll is moveable between a first position adjacent the pad holder at the bottom surface of the receptacle and a second position adjacent the upper surface of the receptacle.

2. The device of claim 1, wherein the handle and the movable arm of the brush roll are connected to each other via a linkage.

3. The device of claim 2, wherein the linkage includes a cam.

4. The device of claim 2, wherein a pivot of the linkage and the motor share at least one common center axis.

5. The device of claim 1, further including a switch disposed about at least one of the block-shaped receptacle or the elongated handle.

6. The device of claim 5, wherein concomitant to the brush roll moving between the first position and the second position the switch activates the motor for driving the brush roll.

7. The device of claim 1, further including a stabilizing leg extending from the block-shaped receptacle such that a space is created between the stabilizing leg and the block-shaped receptacle.

* * * * *